US011404797B2

(12) United States Patent
Tzadok et al.

(10) Patent No.: US 11,404,797 B2
(45) Date of Patent: Aug. 2, 2022

(54) TIME-BASED BEAM SWITCHING IN PHASED ARRAYS

(71) Applicant: International Business Machines Corporation, Armonk, NY (US)

(72) Inventors: Asaf Tzadok, New Castle, NY (US); Bodhisatwa Sadhu, Peekskill, NY (US); Arun Paidimarri, White Plains, NY (US)

(73) Assignee: International Business Machines Corporation, Armonk, NY (US)

( * ) Notice: Subject to any disclaimer, the term of this patent is extended or adjusted under 35 U.S.C. 154(b) by 343 days.

(21) Appl. No.: 16/732,451

(22) Filed: Jan. 2, 2020

(65) Prior Publication Data

US 2021/0210870 A1 Jul. 8, 2021

(51) Int. Cl.

| | |
|---|---|
| ***H01Q 3/24*** | (2006.01) |
| ***H01Q 21/22*** | (2006.01) |
| ***H01Q 21/06*** | (2006.01) |
| ***H01Q 25/00*** | (2006.01) |

(52) U.S. Cl.

CPC ..... *H01Q 21/22* (2013.01); *H01Q 3/24* (2013.01); *H01Q 21/061* (2013.01); *H01Q 25/00* (2013.01)

(58) Field of Classification Search

CPC ..... H01Q 3/24; H01Q 21/22; H01Q 21/061; H01Q 25/00

USPC ..... 342/374

See application file for complete search history.

(56) References Cited

U.S. PATENT DOCUMENTS

| | | | | |
|---|---|---|---|---|
| 4,095,225 | A | 6/1978 | Erikmats | |
| 4,819,000 | A | 4/1989 | Meyer | |
| 5,017,928 | A | 5/1991 | Haupt et al. | |
| 5,515,060 | A | 5/1996 | Hussain et al. | |
| 6,384,782 | B2 | 5/2002 | Erikmats et al. | |
| 8,988,279 | B2 | 3/2015 | Roberge | |
| 9,531,086 | B1 | 12/2016 | Bulzacchelli et al. | |
| 9,948,377 | B1 * | 4/2018 | Kim | H04B 7/0691 |
| 10,770,790 | B1 * | 9/2020 | Mahanfar | H01Q 21/061 |
| 11,166,067 | B1 * | 11/2021 | Mahendra | H04N 21/8456 |
| 2005/0003864 | A1 | 1/2005 | Elliot et al. | |
| 2018/0149466 | A1 | 5/2018 | Floyd et al. | |
| 2018/0269947 | A1 * | 9/2018 | Levitsky | H04B 7/0695 |

(Continued)

FOREIGN PATENT DOCUMENTS

| | | | | |
|---|---|---|---|---|
| CN | 104319483 A * | 1/2015 | | |
| WO | WO-2018120196 A1 * | 7/2018 | | H01P 1/18 |
| WO | WO-2019018035 A1 * | 1/2019 | | G01S 17/89 |

OTHER PUBLICATIONS

Sadhu, B., et al., "A 28GHz SiGe BiCMOS Phase Invariant VGA", 2016 IEEE Radio Frequency Integrated Circuits Symposium (RFIC), May 2016, pp. 150-153.

(Continued)

*Primary Examiner* — Harry K Liu

(74) *Attorney, Agent, or Firm* — Scully, Scott, Murphy & Presser, P.C.; Daniel P. Morris

(57) ABSTRACT

Methods and system for shaping radiation patterns are described. Given a plurality of radiation patterns corresponding to spatial combinations of a plurality of signals, a system can perform beam switching between the given plurality of radiation patterns within a configured time. The beam switching within the configured time can create a beam having a new radiation pattern within the signal modulation bandwidth.

16 Claims, 7 Drawing Sheets

100

(56) References Cited

U.S. PATENT DOCUMENTS

| | | | | |
|---|---|---|---|---|
| 2019/0319356 | A1* | 10/2019 | Shi | H01Q 21/22 |
| 2019/0349949 | A1* | 11/2019 | Bai | H04B 7/0413 |
| 2020/0383060 | A1* | 12/2020 | Park | H04W 52/42 |
| 2021/0210870 | A1* | 7/2021 | Tzadok | H01Q 21/22 |

OTHER PUBLICATIONS

Sadhu, B., et al., "A 28-GHz 32-element TRX phased-array IC with concurrent dual-polarized operation and orthogonal phase and gain control for 5G communications" IEEE Journal of Solid-State Circuits, Nov. 2017, pp. 3373-3391, vol. 52, No. 12.

* cited by examiner

100

500

600

TIME-BASED BEAM SWITCHING IN PHASED ARRAYS

BACKGROUND

The present application relates generally to wireless communication technologies. In one aspect, the present application relates more particularly to beam switching in phased arrays.

In wireless communication technologies, a plurality of antennas (e.g., phased array) can be configured and electronically controlled to create a beam of radio waves that can be electronically steered towards different directions without moving the antennas. In a phased array, power can be fed from a transmitter to devices known as phase shifters, where a phase shifter can be a circuit coupled to an individual antenna. The phase shifters can be controlled by a computer system or a processor, where the computer system can electronically alter the phase of radio waves emitted by individual antennas, causing the beam of radio waves to be steered to different directions.

BRIEF SUMMARY

A method for shaping radiation patterns is generally described. Given a plurality of radiation patterns corresponding to spatial combinations of a plurality of signals, a system can perform beam switching between the given plurality of radiation patterns within a configured time. The beam switching within the configured time can create a beam having a new radiation pattern.

A method for shaping radiation patterns is generally described. Given a plurality of radiation patterns corresponding to spatial combinations of a plurality of signals, a system can perform beam switching between the given plurality of radiation patterns within a configured time. The beam switching within the configured time can create a beam having a new radiation pattern. The beam switching can include performing phase shift control within the configured time. The phase shift control can include maintaining the phase shift of at least one signal that contributes to portions of the plurality of radiation patterns pointing to respective wanted directions. The phase shift control can further include switching the phase shift of at least one signal that contributes to portions of the plurality of radiation patterns pointing to respective unwanted directions, where the switching of the phase shift causes cancellation of signals in the unwanted directions.

A phased array apparatus for shaping radiation patterns is generally described. The phased array apparatus can include a plurality of phase shifters configured to be connected to an array of antenna elements. The phased array apparatus can include a plurality of modulators, each of the plurality of modulators can be connected to one of the plurality of phase shifters. Each of the plurality of phase shifters can be configured to control a phase shift of a signal based on an output by a connected modulator. The phased array apparatus can further include a combiner-splitter module coupled to the plurality of phase shifters. The combiner-splitter module can be configured to divide a source into individual signals and configured to combine phase controlled individual signals received by the array of antenna elements Further features as well as the structure and operation of various embodiments are described in detail below with reference to the accompanying drawings. In the drawings, like reference numbers indicate identical or functionally similar elements.

DETAILED DESCRIPTION

Figure 1:
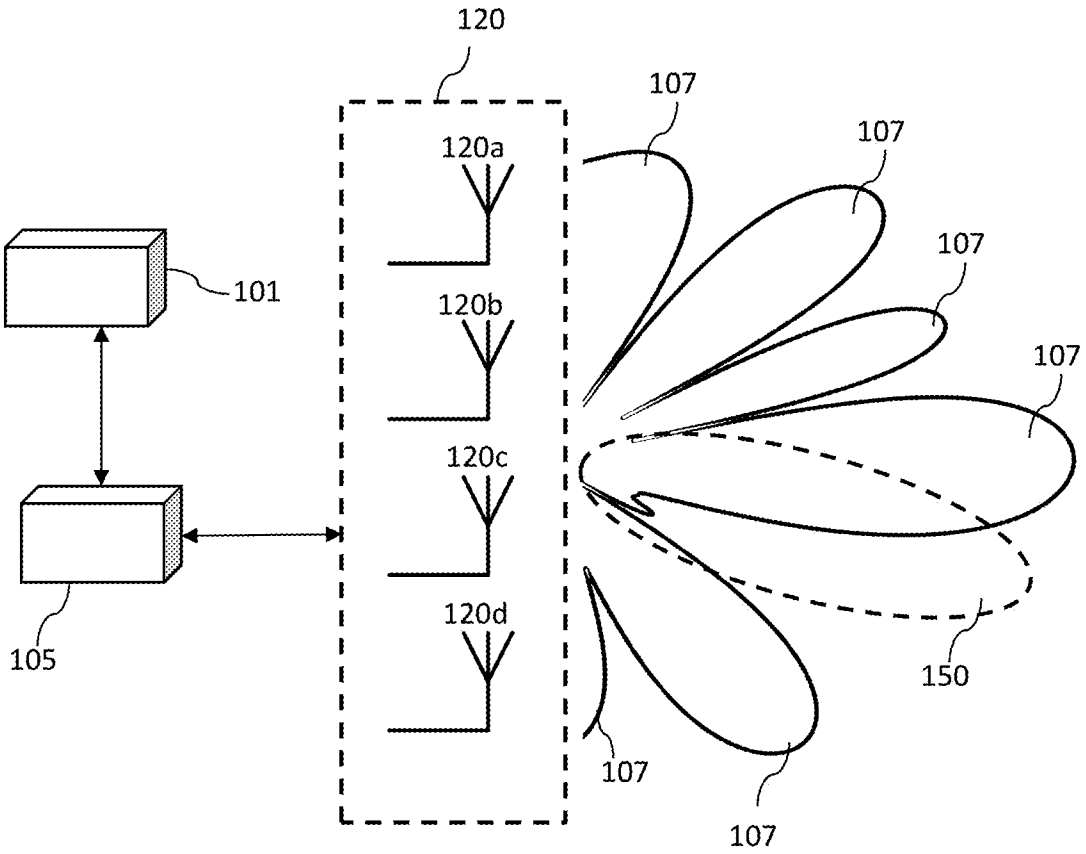
FIG. 1 is a diagram showing an example system that can implement time-based beam switching in phased arrays in one embodiment.

The present application will now be described in greater detail by referring to the following discussion and drawings that accompany the present application. It is noted that the drawings of the present application are provided for illustrative purposes only and, as such, the drawings are not drawn to scale. It is also noted that like and corresponding elements are referred to by like reference numerals.

In the following descriptions, numerous specific details are set forth, such as particular structures, components, materials, dimensions, processing steps and techniques, in order to provide an understanding of the various embodiments of the present application. However, it will be appreciated by one of ordinary skill in the art that the various embodiments of the present application may be practiced without these specific details. In other instances, well-known structures or processing steps have not been described in detail in order to avoid obscuring the present application.

It will be understood that when a first element is connected to a second element, the first and second elements can be operatively connected, communicatively connected, directly connected, or indirectly connected (e.g., with other components in-between).

A phased array can create focused beams for efficient communications and high accuracy radar, by using signals from an array of antennas to create an interference pattern in space. Many different patterns can be created, for example, based on selected functions. An apparatus, system and method according to the present disclosure can use a phase shift control technique to shape any kind of response or radiation pattern. The phase shift control technique described herein can implement a time-based beam switching technique to control beam switching timings and to control a number of times to perform beam switching within a configured time. The beam switching timings can allow generation of beams with any kind of radiation patterns as desired. The methods, systems and devices are disclosed in embodiments, which can improve performance of a wireless communication system by using the time-based beam switching technique to generate antenna beam signals having target radiation patterns.

FIG. 1 is a diagram showing an example system 100 that can implement time-based beam switching in phased arrays in one embodiment. The system 100 can be a wireless communication system. The system 100 can include a device 101 and a device 105. The device 101 can be a computer system, a processor, a controller, and/or other types of hardware that can be configured to control the device 105. The device 105 can be a communication device, such as a transmitter, a receiver, or a transceiver. In an example embodiment, the device 105 can be coupled to, or connected to, a plurality of antennas 120. In another example embodiment, the device 105 can include the plurality of antennas 120. The number of antennas among the plurality of antennas 120 can be arbitrary. In the example shown in FIG. 1, the plurality of antennas 120 can include four antennas 120*a*, 120*b*, 120*c*, 120*d*. The plurality of antennas 120 can form a phased array. In another example embodiment, the device 105 can include one or more interfaces for connecting or coupling to the plurality of antennas 120.

In an example, the system 100 can perform beam switching to switch between known or predetermined radiation patterns corresponding to different antenna beam signals ("beams") 107. The beams 107 can be spatial combinations of a plurality of signals (or modulated signals). For example, the known radiation patterns corresponding to beams 107 can include at least one radiation pattern formed by controlling the phases of individual signals among the plurality of signals to create spatial filters. In another example embodiment, the known radiation patterns corresponding to the beams 107 can include at least one radiation pattern formed by a sinc filter.

In an example embodiment, a first configuration for a phased array can create a first beam among beams 107 pointing in a first direction, and a second configuration for the phased array can create a second beam among beams 107 pointing in a second direction. Beam switching allows a controller (e.g., device 101) of the phased array (e.g., antennas 120) to switch between the known beams 107 depending on a desired implementation of the communication system that is utilizing the phased array. The first and second configurations can include activations of different phase shifters, different orders of activating particular phase shifters, different delays to be applied by the phase shifters, and/or other controls relating to the phase shifters of the phased array.

The system 100 can perform beam switching between the known radiation patterns corresponding to the beams 107 within a configured time. The configured time can be greater than or less than a period corresponding to the maximum modulation frequency of the plurality of signals that can be spatially combined to form beams 107. In some examples, the duration of the configured time can affect a quality (e.g., presence of noise) of the modulated signals being spatially combined to form beam 107. For example, degradation of the modulated signals can increase with an increase in the duration of the configured time. In some example embodiments, the system 100 can be implemented with the configured time being less than the period corresponding to the maximum modulation frequency of the plurality of signals that can be spatially combined to form beams 107. The beam switching within the configured time can create a beam 150 having a new radiation pattern. The beam switching among the known radiation patterns can be performed multiple times within the configured time. The beam switching between the known radiation patterns can be performed in varying intervals of time within the configured time and the time spent in each of the known radiation patterns can vary. For example, the beam switching can spend half the configured time on a first beam, and can spend a quarter of the configured time on a second beam. A number of times within the configured time the beam switching can be performed between the known radiation patterns can be configurable based on the new radiation pattern of the beam 150. For example, the beam switching can select two, three, four, or any arbitrary number of beams among the beams 107, to perform beam switching within the configured time. Further, an order in which the known radiation patterns are switched can be configurable based on the new target radiation pattern of the beam 150. In some examples, the configured time can be adjusted by performing the beam switching for different number of beams, at different order of beam switching, and/or different time durations spent for each beam, until a desired new radiation pattern and/or desired quality of the modulated signals are achieved.

The beam switching performed by the system 100 within the configured time can be referred to as fast beam switching. Fast beam switching can allow the system 100 to create new beams of any arbitrary radiation pattern, direction, strength, and/or other attributes. Further, such fast beam switching technique can create radiation patterns that may not be created using static phase allocations or phase values. The fast beam switching technique can also provide flexibility in creating beams of a desired implementation of the system 100. For instance, beams can be created to increase a range in a particular direction to reach a destination that may be far away. In another instance, beams can be created to widen the beam to provide more coverage. The beams can be created to reduce the side lobes relative to the main beam. The beams can be created to null out certain directions, for example if there is an undesired interferer in that direction.

Figure 2:
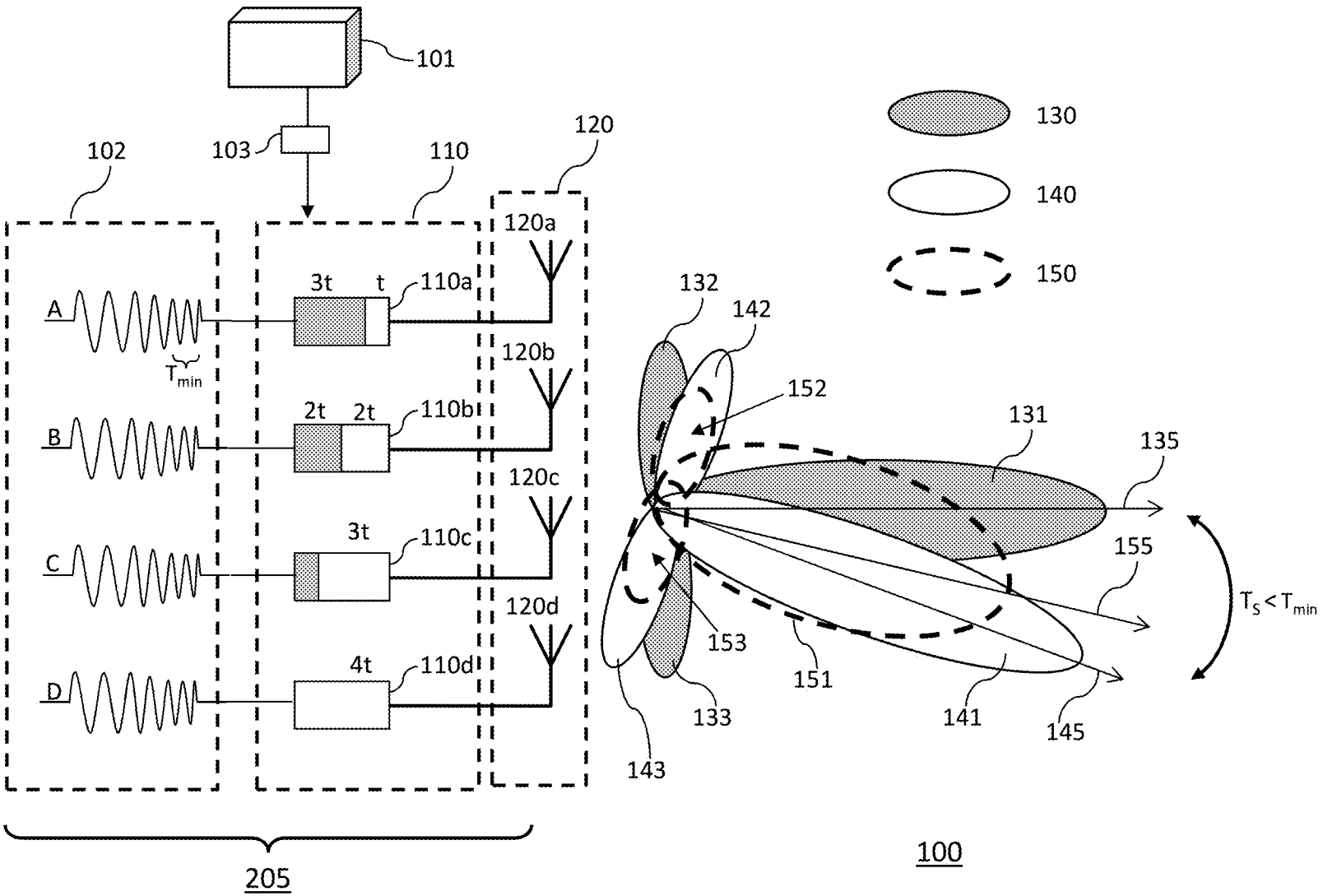
FIG. 2 is a diagram showing an embodiment of time-based beam switching in phased arrays.

FIG. 2 is a diagram showing an example embodiment of time-based beam switching in phased arrays in one embodiment. In the example embodiment shown in FIG. 2, the system 100 can include the device 101 and a device 205. In an embodiment, the device 101 can be a computer processor in communication with the device 205. The device 205 can be a transmitter, a receiver, or a transceiver. In an example embodiment, the device 205 can be coupled to, or connected to, the plurality of antennas 120. In another example embodiment, the device 205 can include the plurality of antennas 120. In another embodiment, the device 205 can include one or more interfaces for enabling the device 205 to be operatively connected or coupled with the plurality of antennas 120. The device 205 can further include a plurality of phase shifters 110. The number of phase shifters among the plurality of phase shifters 110 can be arbitrary. In the example shown in FIG. 2, the plurality of phase shifters 110 can include four phase shifters 110*a*, 110*b*, 110*c*, 110*d*. The phase shifters 110*a*, 110*b*, 110*c*, 110*d* can be coupled to the antennas 120*a*, 120*b*, 120*c*, 120*d*, respectively.

In examples where the device 205 can be a transmitter or a transmitting portion of a transceiver, the antennas 120 can be powered by the transmitter, and a signal can be fed to the antennas 120 through the phase shifters 110. The phase shifters 110 can be controlled by the device 101. In the example shown in FIG. 2, the signals being fed to the antennas 120 can be represented as a plurality of signals 102. The signals 102 can be outputs from a power splitter or divider, and can include a plurality of signals A, B, C, D. In an example, the signals A, B, C, D among signals 102 can be identical, such as having the same amplitude, modulation frequencies, period, phase, signal bandwidth, and/or other attributes. The signals 102 can be analog or digital signals, and the phase shifters 110 can be configured to perform phase shift on analog and/or digital signals. The signals 102 can be spatially combined to form beams (e.g., beams 107 in FIG. 1) having radiation patterns (e.g., analog or digital beamforming) based on phase shifts performed by the phase shifters 110. The phase shifters 110 can delay the signals 102 progressively, such as consecutively to cause each antenna 120 to emit its wavefront later than the one previously. For example, the phase shifters 110 can perform phase shifts progressively from phase shifter 110*a* to 110*d* (from t to 4*t*), causing the antennas 120 to emit their respective wavefronts from antenna 120*a* to 120*d*. The progressive emission by the antennas 120 allow a resulting plane wave or beam to be directed at an angle to the phase array's axis. Changing the phase shift order and activation can change the angle of the beam.

The device 101 can provide an input 103 to the phase shifters 110 to control the phase shifters 110. In an example, the input 103 can be a plurality of control signals to activate individual phase shifters in a particular order or sequence. The device 101 can include a memory device configured to store a plurality of configurations for the phase shifters 110. For example, a first configuration for the phase shifters 110 can include a set of control signals to activate phase shifters 110 in an order from phase shifter 110*a* to 110*d*, at a timed sequence t, 2*t*, 3*t*, 4*t*. The first configuration for the phase shifters can result in the antennas 120 generating an antenna beam signal ("beam") 130 (among the beams 107 in FIG. 1). A second configuration for the phase shifters 110 can include a set of control signals to activate a different set of phase shifters 110, such as phase shifters 110*a*, 110*b*, 110*c*, in an order from phase shifter 110*c* to 110*a* at a timed sequence t, 2*t*, 3*t*. The second configuration for the phase shifters can result in the antennas 120 generating another beam 140 (among the beams 107 in FIG. 1). The stored configurations can correspond to a plurality of given or known radiation patterns corresponding to different spatial combinations of the signals 102.

The beam 130 can have a radiation pattern including a main lobe 131, where the main lobe 131 points at a desired direction 135. The radiation pattern of the beam 130 can include a plurality of side lobes, such as side lobes 132, 133, pointing towards unwanted directions. The beam 140 can have a radiation pattern including a main lobe 141, where the main lobe 141 points at a desired direction 145. The radiation pattern of the beam 140 can include a plurality of side lobes, such as side lobes 142, 143, pointing towards unwanted directions. By storing known configurations that can cause the antennas 120 to generate beams with known radiation patterns, the device 101 can control the device 105 to perform beam switching between different beams. For example, the device 105 may be implemented to transmit in the direction 135. The device 101 can perform beam switching by switching to the first configuration to generate the beam 130 that points in the direction 135. In another example, the device 105 may be implemented to transmit in the direction 145. The device 101 can perform beam switching by switching to the first configuration to generate the beam 140 that points in the direction 145.

The signals A, B, C, D, individually, can be a signal having multiple modulation frequencies. For example, a maximum modulation frequency among the signals A, B, C, D can correspond to a minimum period denoted as $T_{min}$ in FIG. 2. The device 101 can be configured to perform beam switching within a configured time $T_S$, where $T_S$ can be greater than or less than the period $T_{min}$ corresponding to the maximum modulation frequency among the signals A, B, C, D. In an example embodiment, the configured time $T_S$ can be less than half of $T_{min}$. Further, the device 101 can perform beam switching within the configured time $T_S$ (e.g., a beam switching speed) by selecting the first configuration that creates the beam 130, then select the second configuration that creates the beam 140, within the configured time $T_S$. By performing beam switching within the configured time $T_S$, at least some portions of the selected beams 130 and 140 can overlap (or share time), where the overlapped portions can form a desired beam 150. The beam 150 can have a radiation pattern including a main lobe 151, where the main lobe 151 points at a desired direction 155. Note that multiple beam switching can be performed within the configured time $T_S$, such as selecting additional beams to switch within the configured time $T_S$. The different number of selected beams, the individual amount of times spent on the selected beams, and the order in which the beams are selected, can alter the resulting beam 150. The radiation pattern of the beam 150 can include a plurality of side lobes, such as side lobes 152, 153, pointing towards unwanted directions.

By performing beam switching among multiple beams within the configured time $T_S$, time sharing between main and side lobes of different beams can occur. For instance, the signals A, B, C, D can be 100 MHz signals—meaning $T_{min}$ (the period corresponding to the signal bandwidth or the largest modulation frequency among multiple signal carriers) can be approximately 10 nanoseconds (ns) in a single carrier modulation system. In an example, the configured time $T_S$ can be configured to be less than $0.5*T_{min}$, such as $T_S$=4 ns for example. If beam switching is performed among multiple beams within $T_S$=4 ns, the selected beams will experience time sharing, such as having outputted wavefronts overlapping with one another to create a new beam within the wanted signal bandwidth of 100 MHz. For example, using the example in FIG. 2, beam 130 can be selected, and after half of $T_S$ (e.g., 2 ns) lapsed, beam 140 is selected for the other half of $T_S$ (e.g., also 2 ns). The portions of the beam 130 that was emitted by the antennas 120 during the first 2 ns can overlap with the portions of the beam 140 that was emitted by the antennas 120 during the second 2 ns. Based on the time being spent to emit beams 130 and 140 being equivalent, the resulting beam 150 can have a main lobe or desired direction substantially halfway between the desired directions 135 and 145 of the beams 130 and 140, respectively. In another example, beam 130 can be selected, and after three quarters of $T_S$ (e.g., 3 ns) lapsed, beam 140 is selected for a quarter of $T_S$ (e.g., 1 ns). The portions of the beam 130 that was emitted by the antennas 120 during the first 3 ns can overlap with the portions of the beam 140 that was emitted by the antennas 120 during the remaining 1 ns. Based on the time being spent to emit beams 130 and 140 being 3 ns and 1 ns, respectively, the resulting beam 150 can have a main lobe or desired direction 155 situated more closely to the directions 145 of the beam 140 than the direction 135 of the beam 130. Note that the amount of time spent to emit a beam during the beam switching can affect particular portions of the newly form beam. For example, the side lobe of the new beam can be reduced if the phase of the selected beams are opposite, causing removal of signals from unwanted directions. In an embodiment, the new beam can be formed as a function of the weighted average of the times spent of the beams involved in the beam switching within the configured time.

In another example, if a 100 MHz signal is split up into 1,000 sub-carriers using orthogonal frequency-division multiplexing (OFDM) techniques, the sub-carrier spacing can be 100 kHz and each sub-carrier can be modulated at 100 kHz bandwidth, resulting in a symbol period of approximately 10 microseconds (μs) (e.g., $T_{min}$ can be set to 10 μs). Note that since the sub-carriers are modulated at 100 kHz bandwidth, the modulation rate of the sub-carriers are the same and the value of $T_{min}$ can be set to the symbol period. If $T_S$ is less than half the symbol time of 10 μs and beam switching is performed within $T_S$, then the 1,000 sub-carrier modulations can each be averaged to the desired beam pattern. Further, interference between adjacent sub-carriers among the 1,000 sub-carriers can be reduced by performing beam switching at a faster rate within $T_S$. For example, switching beams every 1 ns can be preferred over switching beams every 100 ns. In another example, if the sub-carriers are modulated differently (having different modulation rate), then $T_{min}$ can be set to a period that corresponds to the largest modulation frequency among these sub-carriers.

In examples where the device 205 can be a receiver or a receiving portion of a transceiver, the device 101 can control the phase shifters 110 to steer the antennas 120 to collect signals among beams from different directions. The antennas 120 can forward the collected signals to the phase shifters 110, and the phase differences between the received signals can be used by the device 205 to determine the directions from which the signals were collected. The phase differences and the determined directions can be used by the device 205 to determine a radiation pattern corresponding to the collected signals. The device 205 can combine the collected signals to construct a new signal associated with to the radiation pattern corresponding to the collected signals.

Figure 3:
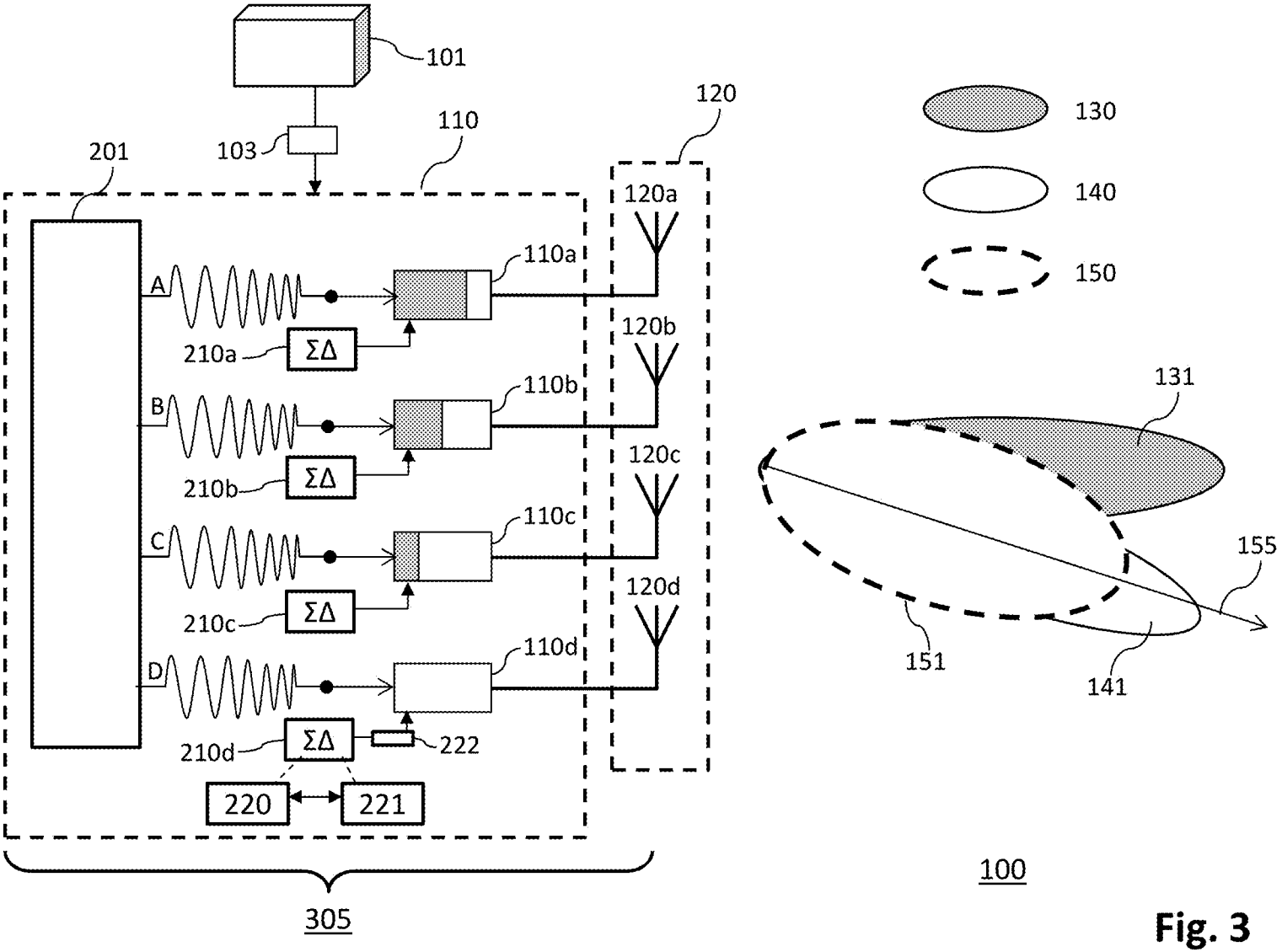
FIG. 3 is a diagram showing another embodiment of time-based beam switching in phased arrays.

FIG. 3 is a diagram showing another embodiment of time-based beam switching in phased arrays. In the example embodiment shown in FIG. 3, the system 100 can include the device 101 and a device 305. In an embodiment, the device 101 can be a computer processor. The device 305 can be a transmitter or a transceiver. In an example embodiment, the device 305 can be coupled to, or connected to, the plurality of antennas 120. In another example embodiment, the device 305 can include the plurality of antennas 120, The device 305 can include the plurality of phase shifters 110. In another example embodiment, the device 305 can include one or more interfaces for connecting or coupling to the plurality of antennas 120.

By way of example, a main lobe can represent the desired or wanted pointing direction, and multiple side lobes can represent unwanted pointing directions. Side lobes can be considered undesirable in both communication and radar systems. In wireless communication systems, side lobes represent unwanted interference. In radar systems, side lobes cause ambiguity and can have an effect on the reliability of radar outputs. In some embodiments, the amplitude of the side lobes can be controlled or changed to reduce presence of side lobes in unwanted directions. However, such amplitude control can alter the gain of the resulting beam. In some examples, fast beam switching can create noise in the signals being used to form the new beam 150, and the created noise can contribute to the side lobes in the beam 150.

In an example, the system 100 can be implemented to create a beam having minimal amount of side lobes. The system 100 can perform beam switching among beams in wanted direction and unwanted side lobe directions. In an embodiment, the device 101 can control phase shifters 110 such that phase shifters 110 contributing to a main lobe of the known beams 107 (including beams 130, 140) remains constant or unchanged in the wanted direction, while other phase shifters is switched to 180 degrees in side lobe or unwanted directions. Based on shifting the other phase shifters that may contribute to generation of side lobes by 180 degrees, the signals in the side lobe directions may be canceled out. Such switching method can produce results similar to phased array amplitude tapering, but without gain or amplitude control; and can produce a flat response outside the direction of interest (e.g., no peaks or nulls). In an aspect, phase switching spreads energy spatially and spectrally.

The device 305 can further include a circuit 201, where the circuit 201 can be a power splitter that may include digital to analog converters (DAC). In an example embodiment, the beam switching being performed within the configured time $T_S$ can include having particular phase shifters maintain constant phase shifts and having other phase shifters perform a defined amount of phase shift. By selectively maintaining and shifting signals corresponding to particular phase shifters during the beam switching performed within the configured time $T_S$, the side lobes 152, 153 (shown in FIG. 2) may be reduced (e.g., smaller amplitude) and in some examples, may be eliminated, from the new beam 150.

In the example shown in FIG. 3, the device 105 can include a plurality of modulators coupled to the plurality of phase shifters 110. For example, a modulator 210*a* can be coupled to the phase shifter 110*a*, a modulator 210*b* can be coupled to the phase shifter 110*b*, a modulator 210*c* can be coupled to the phase shifter 110*c*, and a modulator 210*d* can be coupled to the phase shifter 110*d*. The modulators 210*a*, 210*b*, 210*c*, 210*d* can be sigma-delta modulators configured to perform noise shaping. The modulators 210 can be implemented in the device 305 to reduce the impact of the fast beam switching performed by the system 100, such as reducing noise created by the fast beam switching. Each of the plurality of modulators 210 can be configured to modulate the phase shifts of the signals connected to each antenna 120 so as to move the unwanted frequency components to frequencies outside of the band of interest. For example, the modulators 210*a*, 210*b*, 210*c*, 210*d* can push low frequency noise up to higher frequencies that are outside a frequency band of interest to reduce the impact of the noise. The outputs from the modulators 210*a*, 210*b*, 210*c*, 210*d* can include shaped noise signals that de-emphasize a presence of noise or errors in an input signal.

Using modulator 210*d* as an example, the modulator 210*d* can receive a frequency response of the phase shift performed by the phase shifter 110*d*. The modulator 210*d* can perform noise shaping on the frequency response from the phase shifter 110*d* to generate shaped noise 220. Additional circuits, such as comparators, can be implemented with the modulators 210*a*, 210*b*, 210*c*, 210*d* to compare shaped noises with a threshold noise level 221. The modulator 210*d* can implement such comparator circuits to compare the shaped noise 220 with the threshold noise level 221. If the shaped noise 220 exceeds the threshold noise level 221, the modulator 210*d* may send a signal 222 to the phase shifter 210*d* to configure the phase shifter 110*d*, such as adjusting a phase shift that can be performed by the phase shifter 110*d* by a defined amount. The other modulators, such as 210*a*, 210*b*, 210*c*, can perform the same noise shaping, comparison, and phase shift adjustment, corresponding to their respective phase shifters 110. The adjustment to the phase shifters 110 can cause the phase shifters 110 to perform phase shifts that can push noises created by the beam switching outside of a desired signal band. In an example embodiment, each phase shifter 110 can be configured by their respective modulator to adjust their phase shift by a respective amount. The adjusted phase shifts performed by the phase shifters 110 can create a side lobe cancellation in a direction that can be different from the original side lobe direction. For example, the adjusted phase shifts performed by the phase shifters 110 can create a side lobe cancellation by creating a temporary signal with a 180 degrees phase difference, or in an opposite direction, from the original signal in the side lobe or unwanted direction. Note that other phases, such as phases other than 180 degrees, can result from the phase shift adjustment as well. In some examples, as a result of adjusting the phase shifters 110, a sum of signal phasors of the beams being selected (e.g., beams 130 and 140) in the beam switching can create a minimum output in the unwanted or side lobe directions. The configuration changes to the phase shifters 110 can provide side lobe reduction without amplitude or gain control by cancelling side lobes.

Figure 4:
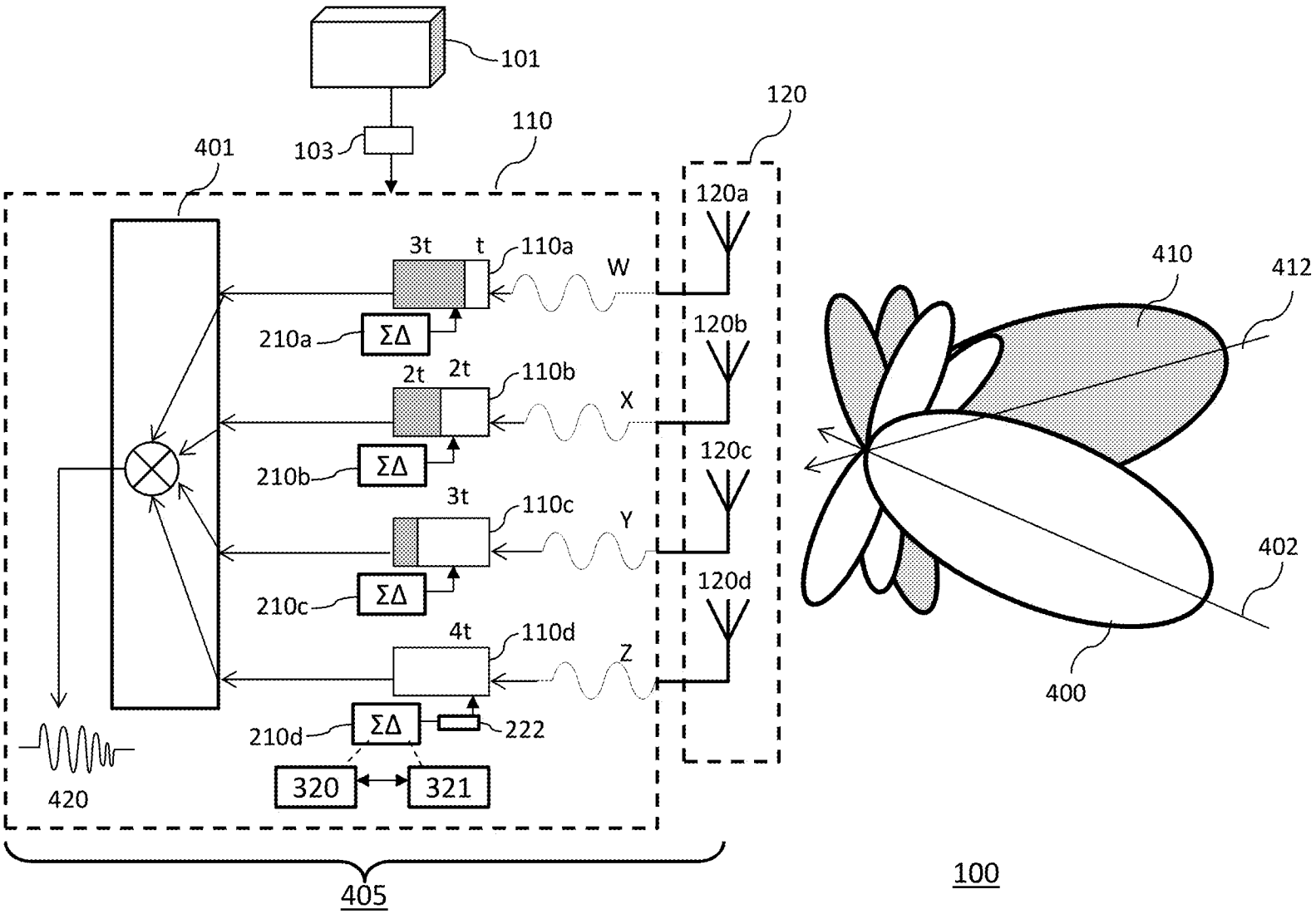
FIG. 4 is a diagram showing another embodiment of time-based beam switching in phased arrays.

FIG. 4 is a diagram showing another embodiment of time-based beam switching in phased arrays. In the example embodiment shown in FIG. 4, the system 100 can include the device 101 and a device 405. The device 101 can be a computer processor. The device 405 can be a receiver or a transceiver. In an example embodiment, the device 405 can be coupled to, or connected to, the plurality of antennas 120. In another example embodiment, the device 405 can include the plurality of antennas 120. The device 405 can further include the plurality of phase shifters 110. In another example embodiment, the device 405 can include one or more interfaces for connecting or coupling to the plurality of antennas 120. In an example embodiment, the device 105 can further include a circuit 201, where the circuit 201 (e.g., FIG. 3) can include a signal or current splitter if the device 105 is a transmitter or a transmitting portion of a transceiver. The device 405 can further include a circuit 401, where the circuit 401 can be a signal combiner that may a plurality of analog to digital converters (ADC) and mixers, for example, for the device 405 to function as a receiver.

In example embodiments where the device 405 can be a receiver (or a receiving portion of a transceiver), the device 405 can receive a beam 400 formed by a spatial combination of a plurality of signals W, X, Y, Z. The signals W, X, Y, Z can be analog or digital signals. For example, the antenna 120*a* may be configured to receive W, and the antenna 120*b* may be configured to receive X, where W and X can be identical signals received by the antennas 120*a* and 120*b* at different times or phases. The antennas 120 can forward the collected signals to a corresponding phase shifter 110. The phase differences between the received signals W, X, Y, Z, can be used by the device 405 to determine the direction 402 from which the beam 400 was received. The phase and relative amplitude of the incoming signals W, X, Y, Z, can be used by the device 405 to determine a radiation pattern of the beam 400. In an example, the phase shifters 110 can perform phase shifts on the collected signals to change a sampling phase according to a phase of the received signal. The modulators 210*a*, 210*b*, 210*c*, 210*d* can perform noise shaping based on frequency responses from the phase shift performed by the phase shifters on the received signals. The shaped noise created by the modulators 210*a*, 210*b*, 210*c*, 210*d* can be used to remove potential noise and errors that are present created by the fast beam switching of the receive signals (for example, as described above).

In an example embodiment, the beam switching being performed within the configured time $T_S$ can include switching configurations of the phase shifters 110 within the configured time $T_S$ to cause the antennas 120 to receive beams or signals from different directions within the configured time $T_S$. For example, within the configured time $T_S$, the device 405 can receive the beam 400 from the direction 402, and perform beam switching to cause the antennas 120 to receive another beam 410 from another direction 412. The beams 400 and 410 received within the configured time $T_S$ can be combined to form a signal 420 corresponding to a new radiation pattern. The amount of time in which the selected beams are being collected within $T_S$ can shape the radiation pattern corresponding to the signal 420. For example, if $T_S$=4 ns, 3 ns was spent to collect beam 400 and 1 ns was spent to collect beam 410, the signal 420 can have a radiation pattern that may be inclined towards the direction 402 since more time was spent on collecting beam 400. In an example, the mixers among the circuit 401 can be configured to mix the outputs (corresponding to beams 400 and 410) from the phase shifters 110 with a signal generated by a local oscillator circuit to construct the signal 420. Further, by receiving beams from different directions within the configured time $T_S$, and by bandpass filtering the signal, interference between the received beams can be reduced.

Figure 5:
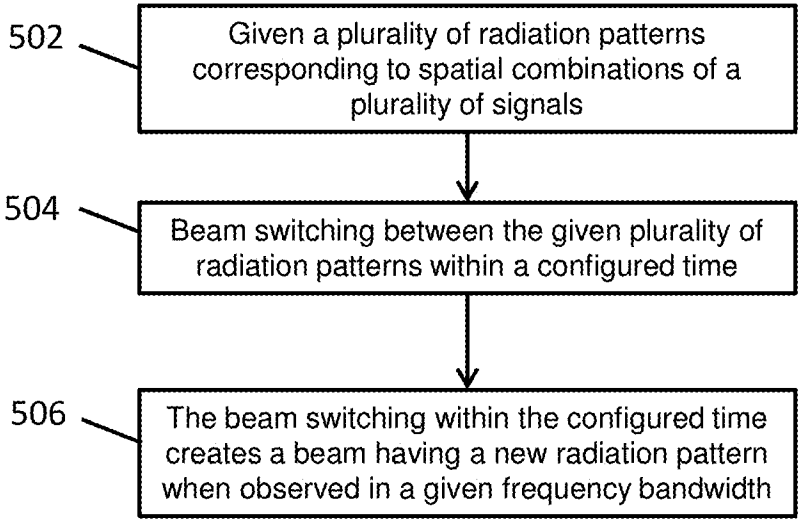
FIG. 5 is a flow diagram illustrating a process to implement time-based beam switching in phased arrays in one embodiment.

FIG. 5 is a flow diagram illustrating a process 500 to implement time-based beam switching in phased arrays in one embodiment. An example process may include one or more operations, actions, or functions as illustrated by one or more of blocks 502, 504, and/or 506. Although illustrated as discrete blocks, various blocks can be divided into additional blocks, combined into fewer blocks, eliminated, or performed in parallel, depending on the desired implementation.

The process 500 can begin at block 502. At block 502, a plurality of radiation patterns can be given. The plurality of radiation patterns can correspond to spatial combinations of a plurality of signals. In some examples, the given plurality of radiation patterns include at least one radiation pattern formed by controlling the phase of the plurality of signals to create spatial filters. In some examples, the given plurality of radiation patterns include at least one radiation pattern formed by a sinc filter.

The process 500 can continue from block 502 to block 504. At block 504, beam switching between the given plurality of radiation patterns can be performed within a configured time. The configured time can be greater than or less than a period corresponding to the maximum modulation frequency among the plurality of signals. In some examples, the configured time can be less than half of the period corresponding to the maximum modulation frequency. In some examples, the beam switching can be performed multiple times between the radiation patterns within the configured time. In some examples, the beam switching between the radiation patterns can be performed in varying intervals of time within the configured time and the time spent in each of the radiation patterns can vary. In some examples, the process 400 can also include configuring or determining various parameters such as the configured time, switch time intervals (e.g., how much time to spend in each pattern), number of switches. The parameters can be configured differently based on the target radiation pattern desired to be formed or created.

The process 500 can continue from block 504 to block 506. At block 506, the beam switching within the configured time can create a beam having a new radiation pattern when observed in a given frequency bandwidth. For example, if the noise from beam switching is shaped to certain high offset frequencies, $\Delta f$, from the carrier frequency, at all offset frequencies less than $\Delta f$, the new radiation pattern will be observed. In some examples, a number of times within the configured time the beam switching is performed between the given plurality of radiation patterns can be configurable based on the new target radiation pattern being formed. In some examples, an order in which the radiation patterns are switched can be configurable based on the new target radiation pattern being formed.

Figure 6:
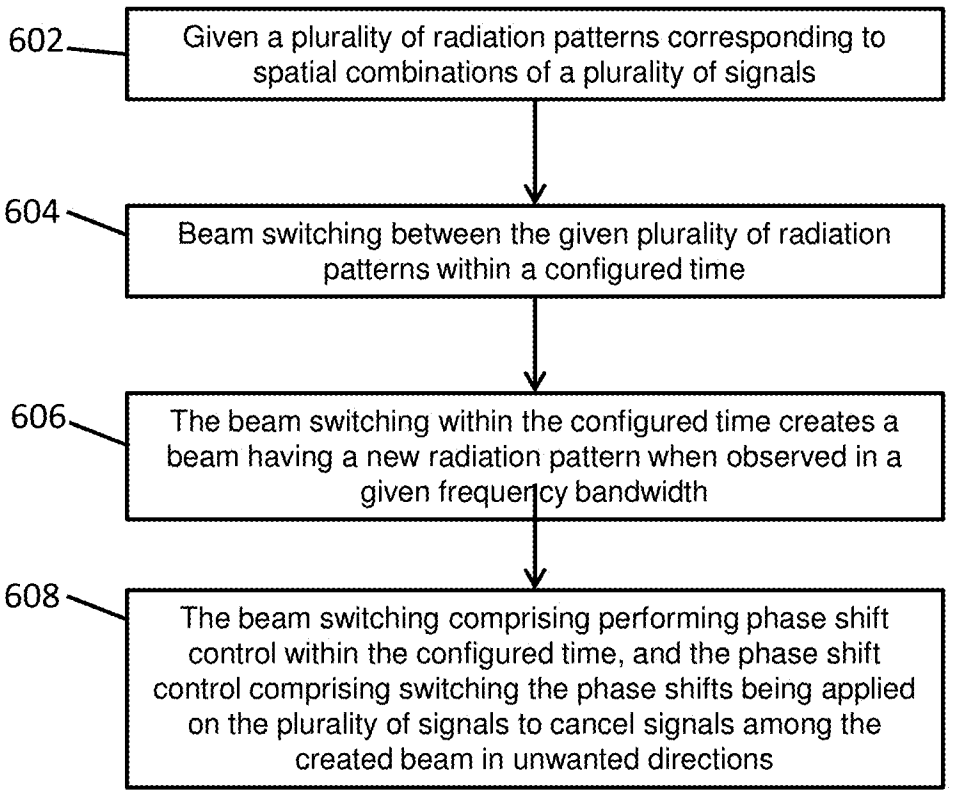
FIG. 6 is a flow diagram illustrating another process to implement time-based beam switching in phased arrays in one embodiment.

FIG. 6 is a flow diagram illustrating a process 600 to implement time-based beam switching in phased arrays in one embodiment. An example process may include one or more operations, actions, or functions as illustrated by one or more of blocks 602, 604, 606, and/or 608. Although illustrated as discrete blocks, various blocks can be divided into additional blocks, combined into fewer blocks, eliminated, or performed in parallel, depending on the desired implementation.

The process 600 can begin at block 602. At block 602, a plurality of radiation patterns can be given. The plurality of radiation patterns can correspond to spatial combinations of a plurality of signals. In some examples, the given plurality of radiation patterns include at least one radiation pattern formed by controlling the phase shift of the plurality of signals to create spatial filters. In some examples, the given plurality of radiation patterns include at least one radiation pattern formed by a sinc filter.

The process 600 can continue from block 602 to block 604. At block 604, beam switching between the given plurality of radiation patterns can be performed within a configured time. The configured time can be greater than or less than a period corresponding to the maximum modulation frequency among the plurality of signals. In some examples, the configured time can be less than half of the period corresponding to the maximum modulation frequency. In some examples, the beam switching can be performed multiple times between the radiation patterns within the configured time. In some examples, the beam switching between the radiation patterns can be performed in varying intervals of time within the configured time and the time spent in each of the radiation patterns can vary.

The process 600 can continue from block 604 to block 606. At block 606, the beam switching within the configured time can create a beam having a new radiation pattern when observed in a given frequency bandwidth. In some examples, a number of times within the configured time the beam switching is performed between the given plurality of radiation patterns can be configurable based on the new target radiation pattern being formed. In some examples, an order in which the radiation patterns are switched can be configurable based on the new target radiation pattern being formed.

The process 600 can continue from block 606 to block 608. At block 608, the beam switching can include performing phase shift control within the configured time. The phase shift control can include switching the phase shifts being applied on the plurality of signals to cancel signals among the created beam in unwanted directions. In some examples, the signals being fed to the phase shifters can be phase shifted by different amounts to create the new radiation pattern.

Figure 7:
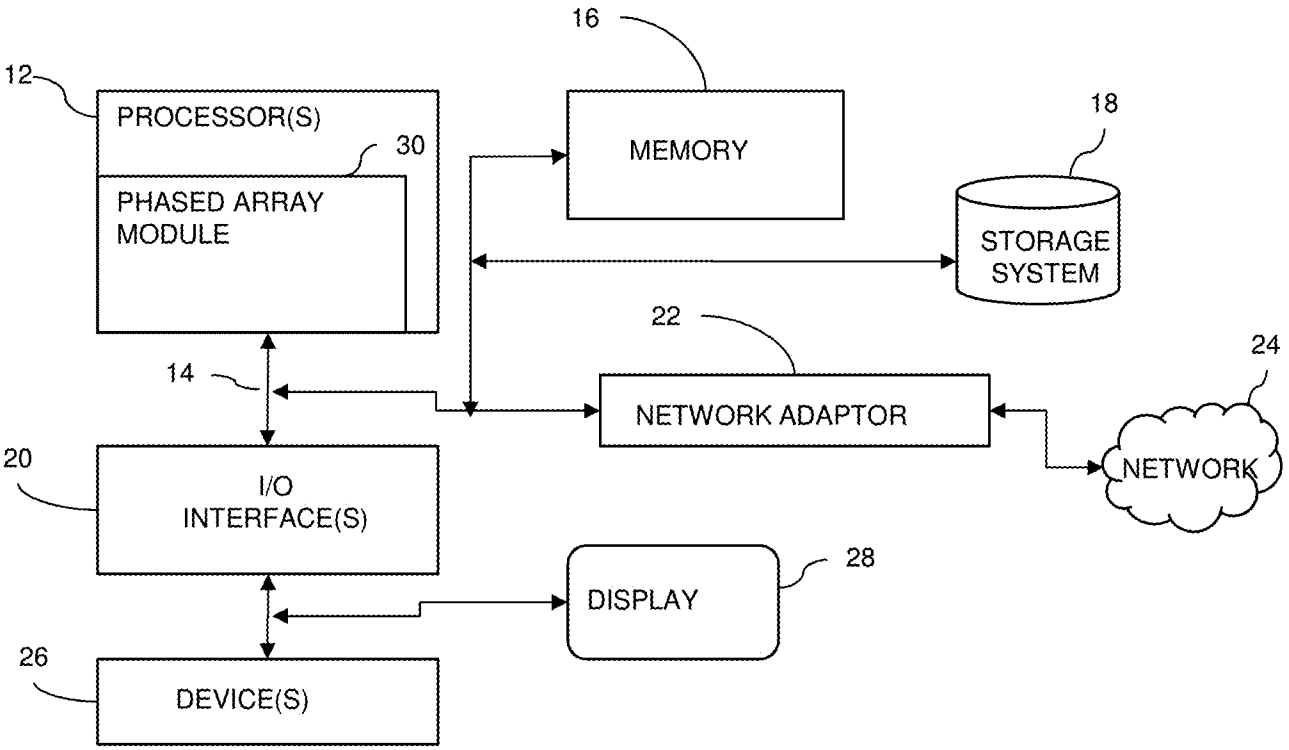
FIG. 7 illustrates a schematic of an example computer or processing system that can implement time-based beam switching in phased arrays in one embodiment of the present disclosure.

FIG. 7 illustrates a schematic of an example computer or processing system that can implement time-based beam switching in phased arrays in one embodiment of the present disclosure. The computer system is only one example of a suitable processing system and is not intended to suggest any limitation as to the scope of use or functionality of embodiments of the methodology described herein. The processing system shown can be operational with numerous other general purpose or special purpose computing system environments or configurations. Examples of well-known computing systems, environments, and/or configurations that can be suitable for use with the processing system shown in FIG. 7 may include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, supercomputers, and distributed cloud computing environments that include any of the above systems or devices, and the like.

The computer system can be described in the general context of computer system executable instructions, such as program modules, being executed by a computer system. Generally, program modules may include routines, programs, objects, components, logic, data structures, and so on that perform particular tasks or implement particular abstract data types. The computer system can be practiced in distributed cloud computing environments where tasks are performed by remote processing devices that are linked through a communications network. In a distributed cloud computing environment, program modules can be located in both local and remote computer system storage media including memory storage devices.

The components of computer system may include, but are not limited to, one or more processors or processing units 12, a system memory 16, and a bus 14 that couples various system components including system memory 16 to processor 12. The processor 12 may include a module 30 (e.g., phased array module 30) that performs the methods described herein. The module 30 can be programmed into the integrated circuits of the processor 12, or loaded from memory 16, storage device 18, or network 24 or combinations thereof.

Bus 14 may represent one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system may include a variety of computer system readable media. Such media can be any available media that is accessible by computer system, and it may include both volatile and non-volatile media, removable and non-removable media.

System memory 16 can include computer system readable media in the form of volatile memory, such as random access memory (RAM) and/or cache memory or others. Computer system may further include other removable/non-removable, volatile/non-volatile computer system storage media. By way of example only, storage system 18 can be provided for reading from and writing to a non-removable, non-volatile magnetic media (e.g., a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 14 by one or more data media interfaces. In some examples, the system memory 16 can include a structure including one or more capacitive processing units as described herein.

Computer system may also communicate with one or more external devices 26 such as a keyboard, a pointing device, a display 28, etc.; one or more devices that enable a user to interact with computer system; and/or any devices (e.g., network card, modem, etc.) that enable computer system to communicate with one or more other computing devices. Such communication can occur via Input/Output (I/O) interfaces 20.

Still yet, computer system can communicate with one or more networks 24 such as a local area network (LAN), a general wide area network (WAN), and/or a public network (e.g., the Internet) via network adapter 22. As depicted, network adapter 22 communicates with the other components of computer system via bus 14. It should be understood that although not shown, other hardware and/or software components could be used in conjunction with computer system. Examples include, but are not limited to: microcode, device drivers, redundant processing units, external disk drive arrays, RAID systems, tape drives, and data archival storage systems, etc.

The present invention can be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. As used herein, the term "or" is an inclusive operator and can mean "and/or", unless the context explicitly or clearly indicates otherwise. It will be further understood that the terms "comprise", "comprises", "comprising", "include", "includes", "including", and/or "having," when used herein, can specify the presence of stated features, integers, steps, operations, elements, and/or components, but do not preclude the presence or addition of one or more other features, integers, steps, operations, elements, components, and/or groups thereof. As used herein, the phrase "in an embodiment" does not necessarily refer to the same embodiment, although it may. As used herein, the phrase "in one embodiment" does not necessarily refer to the same embodiment, although it may. As used herein, the phrase "in another embodiment" does not necessarily refer to a different embodiment, although it may. Further, embodiments and/or components of embodiments can be freely combined with each other unless they are mutually exclusive.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method of shaping radiation patterns, comprising:

given a plurality of radiation patterns corresponding to spatial combinations of a plurality of signals, at least one phase shifter configured to be connected to an antenna element array performing beam switching between the given plurality of radiation patterns within a configured time, wherein the beam switching within the configured time creates a beam having a new radiation pattern, wherein the configured time is less than a period corresponding to the bandwidth of the plurality of signals.

2. The method of claim 1, wherein the beam switching is performed multiple times between the radiation patterns within the configured time.

3. The method of claim 1, wherein the beam switching between the radiation patterns is performed in varying intervals of time within the configured time and the time spent in each of the radiation patterns can vary.

4. The method of claim 1, wherein a number of times within the configured time the beam switching is performed between the given plurality of radiation patterns is configurable based on the new radiation pattern being formed and the bandwidth of the signal.

5. The method of claim 1, wherein an order in which the radiation patterns are switched is configurable based on the new radiation pattern being formed and the bandwidth of the signal.

6. The method of claim 1, wherein the given plurality of radiation patterns include at least one radiation pattern formed by controlling the phase of the plurality of signals.

7. The method of claim 1, wherein the plurality of signals are among a multi-carrier modulation-based signal, and the configured time is less than a period corresponding to a maximum sub-carrier modulation frequency among the subcarriers of the multi-carrier modulation-based signal.

8. A method of phase shift control based side lobe level reduction, comprising:

given a plurality of radiation patterns corresponding to spatial combinations of a plurality of signals, at least one phase shifter configured to be connected to an antenna element array performing beam switching between the given plurality of radiation patterns within a configured time, wherein the beam switching within the configured time creates a beam having a new radiation pattern;

the beam switching comprising performing phase shift control within the configured time, and the phase shift control comprising switching the phase shifts being applied on the plurality of signals to cancel signals among the created beam in unwanted directions, wherein the configured time is less than a period corresponding to the bandwidth of the plurality of signals.

9. The method of claim 8, wherein the plurality of signals are among a multi-carrier modulation-based signal, and the configured time is less than a period corresponding to a maximum modulation frequency among the subcarriers of the multi-carrier modulation based signal.

10. The method of claim 8, wherein the beam switching is performed multiple times between the radiation patterns within the configured time.

11. The method of claim 9, wherein:

the beam switching between the radiation patterns is performed in varying intervals of time within the configured time and the time spent in each of the radiation patterns can vary;

a number of times within the configured time the beam switching is performed between the given plurality of radiation patterns is configurable based on the new target radiation pattern being formed; and an order in which the radiation patterns are switched is configurable based on the new target radiation pattern being formed.

12. A phased array apparatus comprising:

a plurality of phase shifters configured to be connected to an array of antenna elements;

a plurality of modulators, each of the plurality of modulators connected to one of the plurality of phase shifters, said each of the plurality of modulators configured to perform noise shaping based on a frequency response of the phase shift control performed on a connected phase shifter;

each of the plurality of phase shifters configured to control a phase shift of a signal based on an output by a connected modulator; and a combiner-splitter module coupled to the plurality of phase shifters, the combiner-splitter module configured to divide a source into individual signals and configured to combine phase controlled individual signals received by the array of antenna elements, wherein the plurality of phase shifters is configured to receive inputs to perform beam switching among a given plurality of radiation patterns corresponding to spatial combinations of a plurality of signals, the beam switching being performed within a configured time, and the beam switching within the configured time creates a new radiation pattern, wherein the configured time is less than a period corresponding to the bandwidth of the plurality of signals.

13. The apparatus of claim 12, wherein the plurality of modulators are sigma-delta modulators.

14. The apparatus of claim 12, wherein:

the beam switching between the radiation patterns is performed in varying intervals of time within the configured time and the time spent in each of the radiation patterns can vary;

a number of times within the configured time the beam switching is performed between the given plurality of radiation patterns is configurable based on the new target radiation pattern being formed; and an order in which the radiation patterns are switched is configurable based on the new target radiation pattern being formed.

15. The apparatus of claim 12, wherein the plurality of modulators is configured to switch the phase shifts being applied on the plurality of signals to cancel signals among the new radiation pattern in unwanted directions.

16. The apparatus of claim 12, wherein the beam switching is performed multiple times between the radiation patterns within the configured time.

* * * * *